US008460534B2

(12) United States Patent
Krizova et al.

(10) Patent No.: US 8,460,534 B2
(45) Date of Patent: Jun. 11, 2013

(54) CHROMIUM(VI)-FREE BLACK PASSIVATION OF SURFACES CONTAINING ZINC

(75) Inventors: Jaroslava Krizova, Lucany n.N. (CZ); Vaclav Kriz, Lucany n.N. (CZ); Jiri Kloubek, Jablonec n.N. (CZ); Björn Dingwerth, Berlin (DE)

(73) Assignee: Atotech Deutschland GmbH, Berlin (DE)

( * ) Notice: Subject to any disclaimer, the term of this patent is extended or adjusted under 35 U.S.C. 154(b) by 816 days.

(21) Appl. No.: 12/449,930

(22) PCT Filed: Jan. 15, 2008

(86) PCT No.: PCT/EP2008/000259

§ 371 (c)(1), (2), (4) Date: Jan. 14, 2010

(87) PCT Pub. No.: WO2008/107039

PCT Pub. Date: Sep. 12, 2008

(65) Prior Publication Data

US 2010/0133113 A1 Jun. 3, 2010

(30) Foreign Application Priority Data

Mar. 5, 2007 (EP) ..... 07103538

(51) Int. Cl.

| | |
|---|---|
| ***C25D 11/38*** | (2006.01) |
| ***C23C 22/48*** | (2006.01) |
| ***C23C 22/53*** | (2006.01) |
| ***B05D 7/00*** | (2006.01) |
| ***B05D 7/14*** | (2006.01) |

(52) U.S. Cl.

USPC ..... 205/319; 106/1.25; 106/1.27; 148/267; 205/289

(58) Field of Classification Search

USPC ..... 205/319

See application file for complete search history.

(56) References Cited

U.S. PATENT DOCUMENTS

| | | | | |
|---|---|---|---|---|
| 4,169,022 | A | 9/1979 | Ward et al. | |
| 5,415,702 | A | 5/1995 | Bishop et al. | |
| 5,743,971 | A * | 4/1998 | Inoue et al. | 148/247 |
| 6,287,704 | B1 | 9/2001 | Preikschat et al. | |
| 2004/0156999 | A1 | 8/2004 | Biddulph et al. | |
| 2004/0173289 | A1 | 9/2004 | Kinoshita et al. | |
| 2006/0054248 | A1 | 3/2006 | Straus | |
| 2008/0169199 | A1 * | 7/2008 | Huang et al. | 205/210 |

FOREIGN PATENT DOCUMENTS

| | | | |
|---|---|---|---|
| CN | 1670250 | A | 9/2005 |
| DE | 28 22 463 | | 12/1978 |
| DE | 196 15 664 | A1 | 10/1997 |
| DE | 199 05 134 | A1 | 9/2000 |
| DE | 103 05 449 | A1 | 8/2004 |
| EP | 1 484 432 | A1 | 12/2004 |
| EP | 1 734 152 | A1 | 12/2006 |
| EP | 1 944 390 | A1 | 7/2008 |
| GB | 2 097 024 | A | 10/1982 |
| WO | WO-03/005429 | A1 | 1/2003 |
| WO | WO-2006/128154 | A1 | 11/2006 |
| WO | WO-2006/132426 | A2 | 12/2006 |

OTHER PUBLICATIONS

English Abstract of JP 2005 126796, XP-002446038, Dipsol KK, May 19, 2005.

English Abstract of JP 2005 206872, XP-002446039, Nippon Hyomen Kagaku KK, Aug. 4, 2005.

English Abstract of JP 2007 100206, XP-002446040, Dipsol Chem Co. Ltd, Apr. 19, 2007.

English Abstract of JP 2004 346360, XP-002446056, Okuno Pharm Ind. KK, Dec. 9, 2004.

English Abstract of JP 2005-126797, XP-002446081, Dipsol KK, May 19, 2005.

* cited by examiner

*Primary Examiner* — Patrick Ryan
*Assistant Examiner* — William Leader
(74) *Attorney, Agent, or Firm* — Edwards Wildman Palmer LLP; Peter F. Corless; Christine C. O'Day

(57) ABSTRACT

The invention relates to a treatment solution for producing substantially chromium(VI) free black conversion layers on alloy layers containing zinc, the solution comprising the following: (i) at least one first carboxylic acid having 1 to 8 carbon atoms, the acid containing no polar groups with exception of the carboxyl group and being a monocarboxylic acid, (ii) at least one second carboxylic acid having 1 to 8 carbon atoms, comprising at least one further polar group that is selected from —OH, —$SO_3H$, —$NH_2$, —NHR, —$NR_2$, —$NR_3^+$, and —COOH (wherein R is a $C_1$-$C_6$ alkyl group), (iii) 20 to 400 mmol/l $Cr^{3+}$ and (iv) 50 to 2000 mmol/l $NO_3^-$. The invention further provides a method for the black passivation of surfaces containing zinc, wherein the surface to be treated is immersed into such a treatment solution.

22 Claims, No Drawings

CHROMIUM(VI)-FREE BLACK PASSIVATION OF SURFACES CONTAINING ZINC

FIELD OF THE INVENTION

The present invention relates to a treatment solution and method for producing substantially chromium(VI)-free black conversion layers on alloys containing zinc.

BACKGROUND OF THE INVENTION

The use of conversion layers for increasing the protective effect of cathodic corrosion protection systems and as a primer coating for lacquers and paints is known since long time. Especially on zinc, cadmium and aluminium-containing substrates, the method of chromatizing surfaces is established besides phosphatization methods.

Hereby, the surface to be treated is exposed to a treatment solution whose essential component are chromium(VI) compounds. The conversion layer produced thus also contains chromium(VI) ions. Chromatization layers usually exhibit good corrosion protection and good decorative properties. The toxicological properties of chromium(VI) are disadvantageous in the application of chromium(VI)-containing solutions and, respectively, chromium(VI)-containing coatings. The use of chromium(VI)-containing conversion layers is, thus, strongly limited, for example by EC directive 2000/53/EC (EC directive on end-of-live vehicles).

As an alternative to chromatization solutions, chromium (III)-containing, acidic treatment solutions have been proposed which are, in contrast to chromatizations, generally referred to as "passivations" and, respectively, "passivation solutions". Said treatment solutions consist, for example as proposed in DE 196 15 664 A1, essentially of a chromium(III) salt in mineral acid solution, a dicarboxylic acid or a hydroxycarboxylic acid and a cobalt salt. Such methods, known as "thick film passivation", are applied at elevated temperature, about 40-60° C., so as to obtain a passivation layer thickness on zinc surfaces which is sufficient for corrosion protection. The necessity to apply the method at a temperature elevated as compared to room temperature results from the very low reactivity which is characteristic for the chromium(III) ion in contrast to the chromium(VI) ion. A substantial prolongation of the reaction times can, as an alternative to increasing temperature, usually not be realized for economic reasons.

In the case of zinc alloy surfaces such as zinc-iron or, respectively, zinc-nickel or zinc-cobalt, the metal alloyed with zinc is suitable as a black pigment which may be readily produced. By treatment in an acidic solution, the less noble zinc is dissolved from the layer and the alloy metal is, finely dispersed, enriched on the surface. Hereby, the surface is coloured dark or, respectively, almost black. Such a method is, for example, described in DE 199 05 134 A1. Here, an oxidizing agent is additionally applied for the black passivation of zinc-nickel surfaces so as to facilitate the etching effect of the acid. The result is a black surface which, however, does not offer significant corrosion protection.

According to U.S. Pat. No. 5,415,702, Cr(VI)-free black conversion layers on zinc-nickel alloy layers may, alternatively, be produced by treatment with acidic, chromium(III)-containing solutions which further contain oxygen acids of phosphorus. In said method, homogeneously black conversion layers having good decorative properties are formed. In laboratory experimentations, we could, however, not reproduce the corrosion protection described in said document.

WO 03/05429 describes a similar conversion layer which is as well produced using a chromium(III)-containing, acidic treatment solution which further contains phosphate ions. Said surface exhibits as well good decorative properties but does, however, not yield sufficient corrosion protection properties without further steps of post-treatment such as top-coating ("Versiegelung").

EP 1 484 432 A1 describes chromium(III)-containing black passivation solutions for zinc alloy surfaces containing chromium(III) ions and nitrate as well as carboxylic acids, such as tartaric acid, maleic acid, oxalic acid, succinic acid, citric acid, malonic acid or adipic acid. The surface treated therewith must be subjected to a subsequent top-coating so as to improve the corrosion protection. The treatment solutions are applied at temperatures above normal room temperature.

US 2004/0156999 describes as well a method for the black passivation of zinc alloy surfaces. The treatment solutions contain, besides chromium(III) ions and phosphorus-containing anions, nitrate and an organic carboxylic acid. Examples mentioned for the organic carboxylic acids are citric acid, tartaric acid, maleic acid, glyceric acid, lactic acid, glycolic acid, malonic acid, succinic acid, oxalic acid and glutaric acid. Using the treatment solutions described, we did not succeed in realizing the corrosion protection described therein.

Accordingly, it is not possible to produce black passivated zinc and, respectively, zinc alloy surfaces in a fully satisfying manner using the known methods. A particular disadvantage of the described methods is that a black zinc alloy surface providing a good basic corrosion protection ("Grundkorrosionsschutz") cannot be successfully produced. Consequently, post-treatment steps are basically required for improving the corrosion protective properties of the layer.

DESCRIPTION OF THE INVENTION

The object of the present invention is to provide a treatment solution and a method for chromium(VI)-free black passivation of zinc alloys which satisfy the requirements regarding the corrosive properties as imposed by the results obtained using conventional chromium(VI)-containing black chromatizations. Moreover, very good corrosion protective properties shall be conferred to the surface.

Said object is solved by a treatment solution for producing substantially chromium(VI)-free black conversion layers on zinc-containing alloy layers, the solution containing:

- at least one first carboxylic acid having 1 to 8 carbon atoms, the acid containing no polar groups with exception of the carboxylic group and being a monocarboxylic acid,
- at least one second carboxylic acid having 1 to 8 carbon atoms, comprising at least one further polar group that is selected from —OH, —$SO_3H$, —$NH_2$, —NHR, —$NR_2$, —$NR_3^+$ and —COOH (wherein R is a C1-C6 alkyl group),
- 20 to 400 mmol/l $Cr^{3+}$ and
- 50 to 2000 mmol/l $NO_3^-$, and wherein

- the total concentration of carboxyl groups of the first carboxylic acid(s) is within a range of 5 to 150 mmol/l, preferably 10 to 50 mmol/l
- the total concentration of carboxyl groups of the second carboxylic acid(s) is within a range of 5 to 150 mmol/l, preferably 10 to 75 mmol/l
- the ratio of the concentration (in mol/l) of $NO_3^-$ to $Cr^{3+}$ is $\geqq 1$, and
- the following prerequisite is met:

$$0.05 \leq \frac{c(C1)}{c(C2)} * \frac{c(Cr^{3+})}{c(NO_3^-)} \leq 0.5$$

wherein, c(C1) is the total concentration (in mol/l) of carboxyl groups of the first carboxylic acid(s), c(C2) is the total concentration (in mol/l) of carboxyl groups of the second carboxylic acid(s), c(Cr3+) is the concentration (in mol/l) of $Cr^{3+}$, and c(NO3−) is the concentration (in mol/l) of $NO_3^-$.

Furthermore, the invention provides composition yielding, by diluting with water, such a treatment solution.

Moreover, the invention provides a method of black passivation of zinc-containing surfaces wherein the surface to be treated is immersed in such a treatment solution.

The invention relies on the empirically found knowledge that good aesthetic properties (appearance, regularity and colouring) in combination with good corrosion protective properties may be obtained by use of at least one first carboxylic acid as defined above together with at least one second carboxylic acid as defined above, under the concentration conditions referred to above.

The treatment solution is an acidic aqueous solution. Its pH value is preferably within the range of 1.4 to 2.5, more preferably within the range of 1.5 to 2.0.

The first carboxylic acid is preferably an alkyl, aryl, alkenyl or alkynyl carboxylic acid. With exception of the carboxylic group, it does not contain polar, for example protic, groups. In particular, it does not contain any of the following groups: —OH, —$SO_3H$, —$NH_2$, —NHR, —$NR_2$, —$NR_3^+$ (wherein R is a C1-C6 alkyl group). The first carboxylic acid may, however, contain the following groups: halogen, alkyl, aryl, vinyl, alkoxy and nitro groups.

Examples of acids which are suitable as first carboxylic acid comprise formic acid, acidic acid, propionic acid, butyric acid, iso-butyric acid, valeric acid, hexanecarboxylic acid, cyclopentanecarboxylic acid, acetylsalicylic acid, benzoic acid, nitrobenzoic acid, 3,5-dinitrobenzoic acid, sorbic acid, trifluoracetic acid, 2-ethylhexanoic acid, acrylic acid, chloroacetic acid, 2-chlorobenzoic acid, 2-chloro-4-nitrobenzoic acid, cyclopropanecarboxylic acid, methacrylic acid, 3-nitrobenzoic acid, 4-nitrobenzoic acid, phenoxyacetic acid, isovaleric acid, pivelinic acid, 2-ethylbutyric acid, furan-2-carboxylic acid, bromoacetic acid, crotonic acid, 2-chloropropionic acid, dichloroacetic acid, glyoxilic acid, 4-methoxybenzoic acid, 3,4-dimethoxybenzoic acid, levulinic acid, pentenoic acid, phenylacetic acid, tiglic acid, vinylacetic acid.

The first carboxylic acid is preferably acetic acid.

The second carboxylic acid which bears at least one further polar group is preferably a di- or tricarboxylic acid. Amino acids are as well suitable.

Examples for acids which are suitable as second carboxylic acid comprise oxalic acid, malonic acid, succinic acid, glutaric acid, adipic acid, pimelic acid, cork acid or, respectively, suberic acid, azelaic acid, sebacinic acid, maleic acid, phthalic acid, terephthalic acid, tartaric acid, citric acid, malic acid, ascorbic acid, ethylene dinitrilotetraacetic acid, tetrahydrofuran-2-carboxylic acid, ethylene diaminetetraacetic acid, diethylene diaminepentaacetic acid, nitrilotriacetic acid, lactic acid, adipic acid, 4-aminohippuric acid, 4-aminobenzoic acid, 5-aminoisophthalic acid, L-asparagic acid, L-glutamine, L-glutamic acid, alanine, beta-alanine, L-arginine, L-asparagine, L-alanine, N,N-bis(2-hydroxyethyl)-glycine, L-cysteine, L-cystine, glutathione, glycine, glycylglycine, L-histidine, L-hydroxyproline, L-isoleucine, L-leucine, L-lysine, L-methionine, L-ornithine, L-phenylalanine, L-proline, L-serine, L-tyrosine, L-tryptophane, L-threonine, L-valine, N-[tris(hydroxymethyl)-methyl]-glycine, L-citrulline, N-acetyl-L-cysteine, N-(2-acetamido)-iminodiacetic acid, 1,2-cyclohexenylene-dinitrilotetraacetic acid, D(+)-biotine, L-norleucine, 5-aminolevulinic acid, DL-methionine, 3-aminobenzoic acid, 6-aminohexanoic acid, acetylene dicarboxylic acid, pyridine-2,3-dicarboxylic acid, (−)-quinic acid, 4-amino-2-hydroxybenzoic acid, pyridine-2,6-dicarboxylic acid, pyridine-2-carboxylic acid, pyrazine-2,3-dicarboxylic acid, pyrazine-2-carboxylic acid, pyridine-4-carboxylic acid, 3,5-dihydroxybenzoic acid, 2,4-dihydroxybenzoic acid, sebacinic acid, benzene-1,3,5-tricarboxylic acid, furan-2-carboxylic acid, methylene succinic acid, DL-mandelic acid, DL-alpha-aminophenylacetic acid, DL-tropic acid, 2,2'-thiodiacetic acid, 3,3'-thiodipropionic acid, 3-(2-furyl)-acrylic acid, piperidine-4-carboxylic acid, 4-guanidinobenzoic acid, L-homoserine, trans-propene-1,2,3-tricarboxylic acid, (R)-(−)-citramalic acid, (3-s hydroxyphenyl)-acetic acid, 4-hydroxyquinoline-2-carboxylic acid, N-acetyl-L-glutamic acid, N-acetyl-DL-valine, 4-aminohippuric acid, 2,6-dihydroxybenzoic acid, 4-(dimethylamino)-benzoic acid, glucuronic acid, citrazinic acid, indole-3-carboxylic acid, indole-5-carboxylic acid, butane-1,2,3,4-tetracarboxylic acid, DL-leucine, 2,2-bis-(hydroxymethyl)-propionic acid, quinoline-2,4-dicarboxylic acid, 2-aminopyridine-3-carboxylic acid, 5-amino-2-hydroxybenzoic acid, anthranilic acid, benzene-1,2,4-tricarboxylic acid, 3,5-diaminobenzoic acid, 4,8-dihydroxyquinoline-2-carboxylic acid, 3,3-dimethylglutaric acid, trans,trans-2,4-hexadienoic acid, 3-hydroxybutyric acid, o-hydroxyhippuric acid, (4-hydroxyphenyl)-acetic acid, imidazole-4-acrylic acid, indole-2-carboxylic acid, indole-3-propionic acid, mercaptosuccinic acid, 3-oxoglutaric acid, pyridine-2,4-dicarboxylic acid, pyridine-3,5-dicarboxylic acid, 2-methylalanine, 2-sulfobenzoic acid, pyridine-2,5-dicarboxylic acid, gluconic acid, 4-aminobenzoic acid, (−)-shikimic acid, quinaldinic acid, 5-hydroxyisophthalic acid, pyrazole-3,5-dicarboxylic acids, pyridine-3,4-dicarboxylic acid, 1,2-diaminopropanetetraacetic acid, 2-pyridylacetic acid, D-norvaline, 2-methylglutaric acid, 2,3-dibromosuccinic acid, 3-methylglutaric acid, (2-hydroxyphenyl)-acetic acid, 3,4-dihydroxybenzoic acid, diglycolic acid, propane-1,2,3-tricarboxylic acid, 2,3-dimethylaminopropionic acid, 2,5-dihydroxybenzoic acid, 2-hydroxyisobutyric acid, phenylsuccinic acid, N-phenylglycine, 1-aminocylcohexanecarboxylic acid, sarcosine, tropic acid, pyromucic acid, mucic acid.

The carboxylic acids may also be introduced into the treatment solution in the form of their salts.

All compounds which, in aqueous solution, may serve as a source of the corresponding acids, i.e., their esters, acid amides, acid halides, acid nitriles as well as acid anhydrides, are also suitable for producing the treatment solution of the present invention.

Preferably, the treatment solution contains additionally cobalt(II) ions in a concentration within the range of 0.1 g/l to 3 g/l, more preferably within the range of 0.2 g/l to 2 g/l, most preferably within the range of 0.5 g/l to 1 g/l.

The treatment solution of the present invention serves for passivating zinc alloys such as zinc-iron, zinc-nickel or zinc-cobalt alloys.

Zinc-iron alloys preferably contain 0.4 to 1% by weight iron, zinc-nickel alloys contain preferably 8 to 20% by weight nickel and zinc-cobalt alloys contain preferably 0.5 to 5% by weight cobalt.

Said alloys may be electrochemically deposited onto a substrate or applied onto a substrate by means of other method such as hot dip zinc coating or they may form the material of the article to be treated.

Preferably, the ratio $\{c(C1)/c(C2)\}*\{c(Cr^{3+})/c(NO_3^-)\}$ is within the range of 0.1 to 0.2.

In the method for black passivation of zinc-containing surfaces according to the present invention, the surface to be treated is immersed in a treatment solution as described above. The temperature of the treatment solution is thereby preferably within the range of 20° C. to 60° C., more preferably within the range of 20° C. to 40° C., most preferably within the range of 20° C. to 30° C. The processing time in the treatment solution is preferably between 10 s and 180 s, more preferably between 30 s and 120 s, most preferably between 45 s and 90 s. In a preferred embodiment of the method, the passivation treatment is facilitated by cathodic arrangement ("kathodische Schaltung") of the substrate in the passivation solution. Thereby, the cathodic current density on the substrate is preferably between 0.05 A/dm$^2$ and 10 A/dm$^2$, more preferably between 0.1 A/dm$^2$ and 5 A/dm$^2$, most preferably between 0.1 A/dm$^2$ and 3 A/dm$^2$.

Conventional, chromium(VI)-free passivation solutions for zinc-containing surfaces consist usually of a source of chromium(III) ions, one or more complexing agent(s) such as fluoride and/or polyvalent carboxylic acids, hydroxycarboxylic acids or aminocarboxylic acids. Chromium(III) is in the electron configuration 3d$^3$ of the valence electrons and is, in aqueous solutions, almost exclusively known as an octahedrally coordinated ion. In said configuration, the ion shows a high ligand field stabilization energy (LFSE). This results in markedly low reaction velocities at the chromium(III) ion which is, for example, reflected in the necessity to produce chromium(III) complexes either using long reaction times or at elevated temperature. Usually, this aspect is accounted for in the production of passivation solutions by use of hot water in the preparation of or by heating the reaction solution.

In contrast to the Cr(III) ion, the Cr(II) ion having the electron configuration 3d$^4$ exhibits a significantly lower kinetic inhibition and, thus, substantially faster ligand exchange reactions. Water ligands at chromium(III) exchange by several orders of magnitude slower as at chromium(II). If the ion is present in high-spin configuration, the reactivity is additionally increased by the then occurring Jahn-Teller effect. The high-spin arrangement of the electrons in the octahedral complex is observed with ligands generating a comparatively weak ligand field, such as water, oxide. The low-spin case is only observed with ligands generating a very strong ligand field. The cyanide ion is a corresponding example. Such ligands are not contained in the treatment solutions according to the invention. Carboxylate ions which are, according to the invention, a component of the treatment solutions belong to the class mentioned first, i.e., to ligands generating a weak ligand field and forming, thus, high-spin complexes.

The reduction of Cr(III) to chromium(II) ($Cr^{2+} \rightarrow Cr^{3+} + e^-$, $E_0 = -0.41$ V as compared to the standard hydrogen electrode) occurs readily in sufficiently acidic solution on zinc surfaces. The formation of a multidimensional network of μ-hydroxy-linked chromium(III) ions, as generally supposed to be the structure of a chromium(III)-containing conversion layer, occurs most probably by the intermediate step of the reduction of Cr(III) to Cr(II) with subsequent fast ligand exchange. Cr(II) is again readily oxidized to chromium(III) by dissolved aerial oxygen in the presence of humidity. The reduction of Cr(III) to Cr(II) may also occur electrochemically. That is, by cathodic arrangement of the part to be passivated in the reaction solution, the layer formation reaction may be facilitated or may entirely take place via the electrochemical way. Said process leads, optionally applied, to an improvement of the corrosion protection, in particular on black passivated zinc surfaces.

The formation or, respectively, build-up of a dense, low-defect passivation layer is particularly complicated on black surfaces. As black pigment, the alloy metal (for example cobalt, nickel or iron) is frequently generated in enriched, finely dispersed form by etching the surface and dissolving zinc. Alternatively, also the oxides of said elements are produced, depending on the treatment solution.

On pure zinc surfaces, the black colouring is effected, according to the state of the art, by deposition of minor amounts of said metals, nobler as compared to zinc, via cementation by immersing the zinc surface into a solution containing, for example, iron, nickel, cobalt, silver or copper ions. By charge exchange, a thin layer of finely dispersed black metals or, respectively, of the metal oxides, also non-stoichiometric zinc oxides, is formed depending on the treatment solution.

The formation of a passivation layer is hindered on the thus generated black surfaces and results in a poor corrosion protective effect of the black passivation layer.

Said problem is solved by the present invention in that the intermediately occurring Cr(II) ions are converted into a hardly soluble form with the aid of monocarboxylic acids, which contain no further polar groups except the carboxylic group, and are, thus, fixed onto the surface. Thereby, an increased concentration of the merely slowly mobile chromium which is available for the formation of the passive layer ("Passivschicht") is obtained in contrast to the previous methods. If, to be contrary, mainly multivalent carboxylic acids such as oxalic acid, malonic acid, succinic acid or hydroxy carboxylic acids such as lactic acid or multivalent hydroxy carboxylic acids such as citric acid or tartaric acid are used, the Cr(II) optionally coordinated by said acids or, respectively, their anions is not converted to a sparingly soluble form and is, thus, not subject to any enrichment on the surface or, respectively, an enrichment satisfying the purpose.

The use of acetic acid or, respectively, of acetate ions for converting Cr(II) to a sparely soluble form is used in the preparation of chromium(II)-acetate (see following formula). The binuclear structure as found for chromium(II)-acetate is not a prerequisite for the mode of action described in the present invention. Multinuclear complexes having more than one chromium ion and, respectively, also uninuclear complexes may occur intermediately.

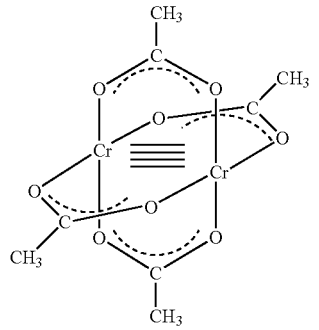

Chromium(II)-acetate forms red crystals which are oxidized to Cr(III) species upon contact with aerial oxygen. Analogously, the chromium species thus enriched at the surface may, under partial or complete ligand exchange, participate in the development of a three-dimensional network under the conditions at the interface metal-solution in the passivation solution.

In addition to an improved basic corrosion protection, a further advantage of the use of monocarboxylic acids resides in their incorporation into the conversion layer. By coordination on chromium ions in the layered network, the surface is rendered hydrophobic by the apolar alkyl, aryl, alkenyl or alkynyl residues and shows an improved affinity to apolar polymers as applied in conventional polymer dispersions.

An increased affinity to hydrophobic polymers is, according to the invention, obtained as compared to conventional chromium(VI)-containing conversion layers and as compared to conversion layers produced from pure di-, tri- or, respectively, hydroxycarboxylic acid or aminocarboxylic acid containing solutions. This affinity is reflected in an improvement of the corrosion protection by application of polymer dispersions on the conversion layers produced according to the invention.

Due to the layer growth accelerated by the low solubility of the intermediately formed chromium(II) complex, the sole use of monocarboxylic acids as chelate ligands usually does not result in a homogeneous black colouration of the layer as it is increasingly isolated against the attack from the reaction solution. By choosing suitable combinations of monocarboxylic acids with at least one second carboxylic acid (for example, a polycarboxylic acid or a hydroxycarboxylic acid) and their concentrations, the concentrations of well-soluble chromium(II) intermediates and of sparingly soluble chromium(II) reaction products on the surface may be adjusted in the sense of a good corrosion protection with concurrent homogeneous and, thus, appealing colouration of the surface. If the composition of the reaction solution satisfies the above prerequisites, favourable concentration ratios are empirically obtained as regards corrosion protection of the zinc-containing surface regarding white corrosion and homogenous, dark colouration of the surface.

In the following, the present invention is explained in more detail by means of examples.

EXAMPLES

Comparative Examples 1 and 2

Aqueous reaction solutions having the following compositions were prepared:

Reaction Solution 1:

4.5 g/l $Cr^{3+}$, added as chromium(III) nitrate nonahydrate
17 g/l nitric acid (65%)

Reaction Solution 2:

4.5 g/l $Cr^{+}$, added as potassium chromium(III) sulphate
17.1 g/l $SO_4^{2-}$, added as potassium chromium(III) sulphate
0.3 g/l $Co^{2+}$, added as cobalt(II) sulphate hexahydrate
90 mg/l $NO_3^{-}$, added as nitric acid
1 g/l oxalic acid dihydrate
1 g/l acetic acid
1 g/l maleic acid The pH value of the solution was adjusted in each case to pH 1.5 using nitric acid or, respectively, sodium hydroxide.

A steelwork element was coated with a 5 μm thick layer of a zinc-nickel alloy having 14% nickel content in an alkaline zinc-nickel alloy electrolyte (trade name: Reflectalloy ZNA; producer: Atotech). The steelwork element was then immersed in a nitric acid-water mixture (about 0.3% $HNO_3$) for 10 s at 20° C. so as to activate the surface. The element was subsequently rinsed with demineralised water and was immediately immersed in the reaction solution 1 or, respectively, 2 as produced above, at 25° C. for 60 s, then rinsed with demineralised water and dried. In both cases, the surface of the element had taken on a matt, dark to dark brown colouration. In the salt spray test according to DIN 50021 SS, the surface showed, in average, white corrosion already after <12 h.

Exemplary Embodiments 1-6

Aqueous reaction solutions having the compositions indicated in Table 1 were produced (the single components were added in the same form as in Comparative Example 2). The pH value of the solution was in each case adjusted to the value indicated in Table 1 using nitric acid or sodium hydroxide.

Steelwork elements were electrolytically coated using the Zn-containing alloy indicated in Table 1 under the heading "substrate", were thoroughly rinsed using demineralised water following the electrolytic coating, then activated at 20-30° C. for 10 s in 0.3% nitric acid and were, then, again thoroughly rinsed. The elements were subsequently immersed in the reaction solutions under the conditions (temperature, exposition time) indicated in Table 1. Then, a top-coating ("Versiegelung") with Corrosil 501, which consists of an aqueous polymer dispersion having silicatic components, was applied. The results of the visual evaluation (colour) and of the salt spray test according to DIN 50021 SS before and after application of the top-coating (time until the occurrence of white corrosion) are as well indicated in Table 1.

TABLE 1

| | Example | | | | | |
|---|---|---|---|---|---|---|
| | 1 | 2 | 3 | 4 | 5 | 6 |
| $Cr^{3+}$ | 4.5 g/l | 4.5 g/l | 4.5 g/l | 4.5 g/l | 4.5 g/l | 4.5 g/l |
| $NO_3^{-}$ | 17 g/l | 17 g/l | 17 g/l | 17 g/l | 17 g/l | 17 g/l |
| $Co^{2+}$ | 0.3 g/l | 0.3 g/l | 0.3 g/l | 0.3 g/l | 0.3 g/l | 0.6 g/l |
| formic acid | 0 g/l | 0 g/l | 0 g/l | 0 g/l | 0 g/l | 0.8 g/l |
| acetic acid | 3.5 g/l | 1 g/l | 1 g/l | 0 g/l | 0 g/l | 0 g/l |
| propionic acid | 0 g/l | 0 g/l | 0 g/l | 0 g/l | 1.3 g/l | 0 g/l |
| benzoic acid | 0 g/l | 0 g/l | 0 g/l | 2 g/l | 0 g/l | 0 g/l |
| oxalic acid dihydrate | 0 g/l | 1 g/l | 1 g/l | 1 g/l | 1 g/l | 1 g/l |
| maleic acid | 0 g/l | 1 g/l | 1.5 g/l | 1 g/l | 1 g/l | 1 g/l |
| pH | 1.5 | 1.5 | 1.5 | 1.5 | 1.5 | 1.5 |
| temperature | 25° C. | 25° C. | 25° C. | 25° C. | 25° C. | 25° C. |
| exposition | 60 s | 60 s | 60 s | 60 s | 60 s | 60 s |

TABLE 1-continued

| | Example | | | | | |
|---|---|---|---|---|---|---|
| | 1 | 2 | 3 | 4 | 5 | 6 |
| time | | | | | | |
| substrate(*) | Zn/Ni | Zn/Ni | Zn/Ni | Zn/Ni | Zn/Ni | Zn/Ni |
| colour | spotted dark | glossy, homogenously black | evenly black | evenly black | evenly black | black, slightly matt |
| DIN 50021 SS | 48 h | 72 h | 72 h | 72 h | 72 h | 48 h |
| top-coating | Corrosil 501 | Corrosil 501 | Corrosil 501 | Corrosil 501 | Corrosil 501 | Corrosil 501 |
| DIN 50021 SS | 144 h | 240 h | 240 h | 240 h | 192 h | 144 h |

(*)Zn/Ni = Zn/Ni alloy having 8-15% nickel content in the alloy

Comparative Examples 3 and 4

Exemplary embodiment 3 was repeated wherein, however, the concentrations of acetic acid and, respectively, of oxalic acid had been altered as indicated in Table 2. The results of the evaluation of the colouration and of the corrosion properties are as well indicated in Table 2

TABLE 2

| Vergleichs-beispiel | 3 | 4 |
|---|---|---|
| $Cr^{3+}$ | 4.5 g/l | 4.5 g/l |
| $NO_3^-$ | 17 g/l | 17 g/l |
| $Co^{2+}$ | 0.3 g/l | 0.3 g/l |
| formic acid | 0 g/l | 0 g/l |
| acetic acid | 5 g/l | 1 g/l |
| propionic acid | 0 g/l | 0 g/l |
| benzoic acid | 0 g/l | 0 g/l |
| oxalic acid dihydrate | 1 g/l | 9 g/l |
| maleic acid | 1.5 g/l | 1.5 g/l |
| pH | 1.5 | 1.5 |
| temperature | 25° C. | 25° C. |
| exposition time | 60 s | 60 s |
| substrate (*) | Zn/Ni | Zn/Ni |
| colour | spotted, brown | evenly black |
| DIN 50021 SS | 48 h | 24 h |
| top-coating | Corrosil 501 | Corrosil 501 |
| DIN 50021 SS | 120 h | 72 h |

(*) Zn/Ni = Zn/Ni alloy having 8-15% nickel content in the alloy

Comparative Example 3 shows that only a poor colouration of the treated surface is obtained if the concentration of carboxylic groups from monocarboxylic acids is too high.

Comparative Example 4 shows that only poor corrosion properties of the treated surface are obtained if the concentration of carboxylic groups from polycarboxylic acids is too high.

The invention claimed is:

1. A treatment solution for producing substantially chromium(VI)-free black conversion layers on zinc-containing alloy layers, the solution containing:

at least one first carboxylic acid having 1 to 8 carbon atoms, the acid containing no polar groups with exception of the carboxylic group and being a monocarboxylic acid, at least one second carboxylic acid having 1 to 8 carbon atoms, comprising at least one further polar group that is selected from —OH, —$SO_3H$, —$NH_2$, —NHR, —$NR_2$, —$NR_3^+$ and —COOH (wherein R is a $C_1$-$C_6$ alkyl group), 20 to 400 mmol/l $Cr^{3+}$ and 50 to 2000 mmol/l $NO_3^-$, and wherein the total concentration of carboxyl groups of the first carboxylic acid(s) is within a range of 5 to 150 mmol/l, the total concentration of carboxyl groups of the second carboxylic acid(s) is within a range of 5 to 150 mmol/l, the ratio of the concentration (in mol/l) of $NO_3^-$ to $Cr^{3+}$ is ≧1, and the following prerequisite is met:

$$0.1 \leq \frac{c(C1)}{c(C2)} * \frac{c(Cr^{3+})}{c(NO_3^-)} \leq 0.2$$

wherein, c(C1) is the total concentration (in mol/l) of carboxyl groups of the first carboxylic acid(s), c(C2) is the total concentration (in mol/l) of carboxyl groups of the second carboxylic acid(s), $c(Cr^{3+})$ is the concentration (in mol/l) of $Cr^{3+}$, and $c(NO_3^-)$ is the concentration (in mol/l) of $NO_3^-$.

2. The treatment solution according to claim 1, wherein the pH value of the solution is within the range of 1.4 to 2.5.

3. The treatment solution according to claim 1, wherein the pH value of the solution is within the range of 1.5 to 2.0.

4. The treatment solution according to claim 1, wherein the first carboxylic acid is selected from the group consisting of formic acid, acetic acid, propionic acid, butyric acid, pentanoic acid, hexanoic acid, benzoic acid, heptanoic acid, propargylic acid, acrylic acid, methacrylic acid, ethacrylic acid, crotonic acid, cyclohexenoic acid, cyclohexanoic acid, cyclopentanoic acid, cyclopentenoic acid and 2-butynic acid as well as isomers thereof.

5. The treatment solution according to claim 1, wherein the second carboxylic acid is a dicarboxylic acid.

6. The treatment solution according to claim 1, wherein the second carboxylic acid is selected from the group consisting of oxalic acid, malonic acid, succinic acid, glutaric acid, adipic acid, pimelic acid, cork acid, azelaic acid, sebacinic acid, maleic acid, phthalic acid, terephthalic acid, tartaric acid, citric acid, malic acid, ascorbic acid, ethylene dinitrilotetraacetic acid, tetrahydrofuran-2-carboxylic acid, ethylene diaminetetraacetic acid, diethylene diaminepentaacetic acid, nitrilotriacetic acid, lactic acid, adipic acid, 4-aminohippuric acid, 4-aminobenzoic acid, 5-aminoisophthalic acid, L-asparagic acid, L-glutamine, L-glutamic acid, alanine, beta-alanine, L-arginine, L-asparagine, L-alanine, N,N-bis (2-hydroxyethyl)-glycine, L-cysteine, L-cystine, glutathione, glycine, glycylglycine, L-histidine, L-hydroxyproline, L-isoleucine, L-leucine, L-lysine, L-methionine, L-ornithine, L-phenylalanine, L-proline, L-serine, L-tyrosine, L-tryptophane, L-threonine, L-valine, N-[tris(hydroxymethyl)-methyl]-glycine, L-citrulline, N-acetyl-L-cysteine, N-(2-acetamido)-iminodiacetic acid, 1,2-cyclohexenylene-dinitrilotetraacetic acid, D(+)-biotine, L-norleucine, 5-aminolevulinic acid, DL-methionine, 3-aminobenzoic acid, 6-aminohexanoic acid, acetylene dicarboxylic acid, pyridine-2,3-dicarboxylic acid, (−)-quinic acid, 4-amino-2-hydroxybenzoic acid, pyridine-2,6-dicarboxylic acid, pyridine-2-carboxylic acid, pyrazine-2,3-dicarboxylic acid, pyrazine-2-carboxylic acid, pyridine-4-carboxylic acid, 3,5-diyhdroxybenzoic acid, 2,4-dihydroxybenzoic acid, sebacinic acid, benzene-1,3,5-tricarboxylic acid, furan-2-carboxylic acid, methylene succinic acid, DL-mandelic acid, DL-alpha-aminophenylacetic acid, DL-tropic acid, 2,2'-thiodiacetic acid, 3,3'-thiodipropionic acid, 3-(2-furyl)-acrylic acid, piperidine-4-carboxylic acid, 4-guanidinobenzoic acid, L-homoserine, trans-propene-1,2,3-tricarboxylic acid, (R)-(−)-citramalic acid, (3-hydroxyphenyl)-acetic acid, 4-hydroxyquinoline-2-carboxylic acid, N-acetyl-L-glutamic acid, N-acetyl-DL-valine, 4-aminohippuric acid, 2,6-dihydroxybenzoic acid, 4-(dimethylamino)-benzoic acid, glucuronic acid, citrazinic acid, indole-3-carboxylic acid, indole-5-carboxylic acid, butane-1,2,3,4-tetracarboxylic acid, DL-leucine, 2,2-bis-(hydroxymethyl)-propionic acid, quinoline-2,4-dicarboxylic acid, 2-aminopyridine-3-carboxylic acid, 5-amino-2-hydroxybenzoic acid, anthranilic acid, benzene-1,2,4-tricarboxylic acid, 3,5-diaminobenzoic acid, 4,8-dihydroxyquinoline-2-carboxylic acid, 3,3-dimethylglutaric acid, trans,trans-2,4-hexadienoic acid, 3-hydroxybutyric acid, o-hydroxyhippuric acid, (4-hydroxyphenyl)-acetic acid, imidazole-4-acrylic acid, indole-2-carboxylic acid, indole-3-propionic acid, mercaptosuccinic acid, 3-oxoglutaric acid, pyridine-2,4-dicarboxylic acid, pyridine-3,5-dicarboxylic acid, 2-methylalanine, 2-sulfobenzoic acid, pyridine-2,5-dicarboxylic acid, gluconic acid, 4-aminobenzoic acid, (−)-shikimic acid, quinaldinic acid, 5-hydroxyisophthalic acid, pyrazole-3,5-dicarboxylic acids, pyridine-3,4-dicarboxylic acid, 1,2-diaminopropanetetraacetic acid, 2-pyridylacetic acid, D-norvaline, 2-methylglutaric acid, 2,3-dibromosuccinic acid, 3-methylglutaric acid, (2-hydroxyphenyl)-acetic acid, 3,4-dihydroxybenzoic acid, diglycolic acid, propane-1,2,3-tricarboxylic acid, 2,3-dimethylaminopropionic acid, 2,5-dihydroxybenzoic acid, 2-hydroxyisobutyric acid, phenylsuccinic acid, N-phenylglycine, 1-aminocylcohexanecarboxylic acid, sarcosine, tropic acid, pyromucic acid, and mucic acid.

7. The treatment solution according to claim 1, wherein the solution additionally contains cobalt(II) ions in a concentration within a range of 0.1 g/l to 3 g/l.

8. The treatment solution according to claim 7, wherein the concentration of the cobalt(II) ions is within a range of 0.2 g/l to 2 g/l.

9. The treatment solution according to claim 7, wherein the concentration of the cobalt(II) ions is within a range of 0.5 g/l to 1 g/l.

10. A composition yielding, by diluting with water, a treatment solution according to claim 1.

11. The composition according to claim 10, wherein the composition contains a salt, an ester, an acid amide, an acid halide, an acid nitrile, and/or an acid anhydride of the carboxylic acid(s) which releases the carboxylic acid in the aqueous treatment solution.

12. A method of black passivation of zinc-containing surfaces wherein the surface to be treated is immersed in a treatment solution according to claim 1.

13. The method according to claim 12, wherein the temperature of the treatment solution is within a range of 20° C. to 60° C.

14. The method according to claim 12, wherein the temperature of the treatment solution is within a range of 20° C. to 40° C.

15. The method according to claim 12, wherein the temperature of the treatment solution is within a range of 20° C. to 30° C.

16. The method according to claim 12, wherein the processing time in the treatment solution is between 10 s and 180 s.

17. The method according to claim 12, wherein the processing time in the treatment solution is between 30 s and 120 s.

18. The method according to claim 12, wherein the processing time in the treatment solution is between 45 s and 90 s.

19. The method according to claim 12, wherein the passivation treatment is facilitated by cathodic arrangement of the substrate in the passivation solution.

20. The method according to claim 19, wherein the cathodic current density on the substrate is between 0.05 $A/dm^2$ and 10 $A/dm^2$.

21. The method according to claim 19, wherein the cathodic current density on the substrate is between 0.1 $A/dm^2$ and 5 $A/dm^2$.

22. The method according to claim 19, wherein the cathodic current density on the substrate is between 0.1 $A/dm^2$ and 3 $A/dm^2$.

* * * * *